United States Patent [19]

Bell

[11] Patent Number: 4,515,080

[45] Date of Patent: May 7, 1985

[54] INERTIA TYPE FRICTION INITIATOR FOR ROTATING PROJECTILES

[75] Inventor: Frank H. Bell, Logan, Utah

[73] Assignee: Thiokol Corporation, Chicago, Ill.

[21] Appl. No.: 453,317

[22] Filed: Dec. 27, 1982

[51] Int. Cl.[3] ..... F42C 19/08

[52] U.S. Cl. ..... 102/205

[58] Field of Search ..... 102/205, 272, 275

[56] References Cited

U.S. PATENT DOCUMENTS 3,942,445 3/1976 Baker et al. ..... 102/205

3,976,008 8/1976 Altschuler et al. ..... 102/205

*Primary Examiner*—Charles T. Jordan

*Attorney, Agent, or Firm*—Gerald K. White

[57] ABSTRACT

An inertia type friction initiator for rotating projectiles includes a metallic mass, retained by a shear pin and joined to one end of a metal twisted or braided wire or cable, that is set in motion upon impact of the containing projectile with a resistant media, the target. Friction of the cable with a friction primer mixture sets off the mixture. The mixture activates a booster explosive that, in turn, detonates to produce a blase wave which explodes the main charge of high explosive of the projectile. A keeper-washer/sleeve system connected to the cable prevents premature activation by projectile rotational acceleration on the flight axis. The other end of the cable is embedded in the friction primer mixture at an angle of 90 degrees to the central or flight axis. Minor on-axis impacts that may tend to occur during storage, handling, shipment and loading are precluded from causing initiator actuation by proper selection of the shear pin.

6 Claims, 2 Drawing Figures

INERTIA TYPE FRICTION INITIATOR FOR ROTATING PROJECTILES

BACKGROUND OF THE INVENTION

1. Field of the Invention

The present invention relates to an improvement in self-arming fuzes or initiators for rotating or spinning point striking or side striking projectiles used in gun cannon, tank cannon and artillery rockets which spin.

2. Description of the Prior Art

The final functioning of a projectile is controlled by an explosive device that is commonly termed a fuze or initiator. An initiator normally has elements to set off the projectile, to prevent its premature functioning, and to cause it to function as desired only under predetermined conditions. These conditions determine the type of initiator that is needed. A general requirement of initiators for setting off projectiles and similar munitions, however, is that they normally be inactivated or desensitized for safe handling, transportation and storage.

An impact fuze or initiator is one which functions as it hits the target. Particular requirements of this type of initiator, as applicable particularly to rotating projectiles, are that the initiator be non-responsive to the forward motion and axial rotation of the projectile resulting from being launched or shot forward from a gun, and that it be set off or detonated upon impact of the projectile with a resistant target medium.

The construction of this type of initiator has become very complex and expensive. There thus exists a demand or a need for a very simple initiator, desirably one characterized by having a minimum of moving parts and no springs, which requires no arming before projectile launch but is actuated upon impact, which will neither be actuated by minor on-axis impacts during storage, handling and shipment, nor when subjected to linear, radial and tangential accelerations, as upon projectile launch.

SUMMARY OF THE INVENTION

An object of the invention is to provide an improved fuze or initiator for projectiles having the aformentioned characteristics.

A more specific object of the invention is to provide an inertia actuated friction initiator having particular application to projectiles rotating or spinning on the flight axis.

In accomplishing these and other objectives of the invention, there is provided a metallic mass, retained by a shear pin and joined to one end of a metal twisted or braided wire or cable, that is set in motion upon impact of the containing projectile with a resistant media, specifically the target. Friction of the cable with a friction primer mixture sets off the mixture. Flame communicates with a booster explosive which detonates and establishes a blast wave to the main charge of a high explosive which then explodes. A keeper-washer/-sleeve system prevents premature actuation by projectile rotational acceleration on the flight axis. The other end of the cable is embedded in the friction primer mixture at an angle of about 90 degrees to the central or flight axis of the projectile.

BRIEF DESCRIPTION OF THE DRAWINGS

Having summarized the invention, a detailed description follows with reference being had to the accompanying drawings which form part of the specificiation, of which.

DESCRIPTION OF THE PREFERRED EMBODIMENT

Figure 1:
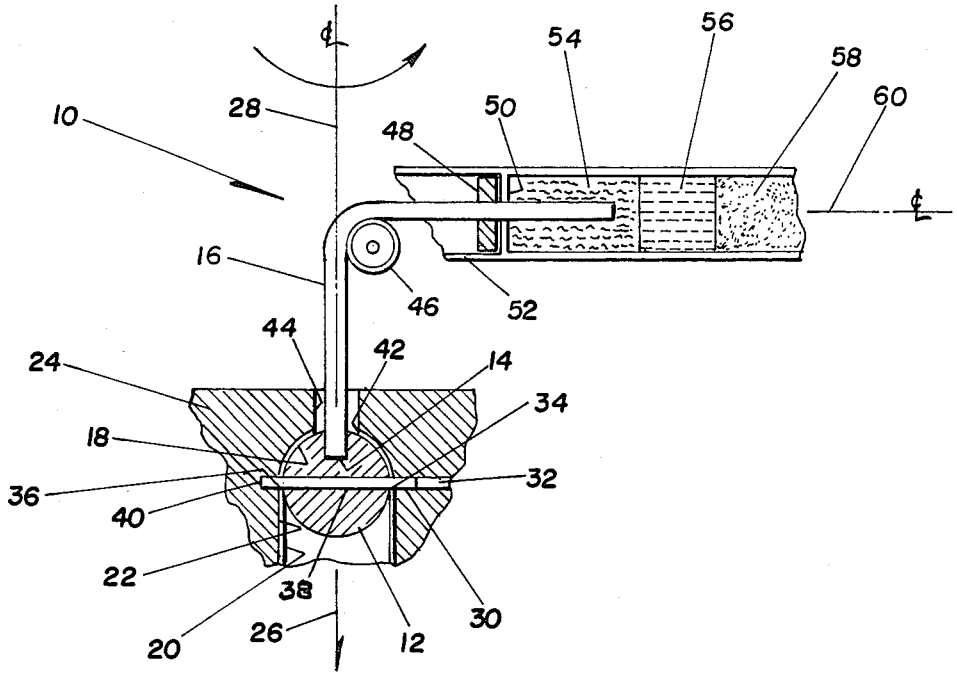
FIG. 1 is a schematic longitudinal sectional view of a preferred embodiment of the inertia type friction initiator for a rotating projectile according to the invention.

There is provided in the preferred embodiment, illustrated in FIG. 1, an initiator for a projectile. The initiator is designated generally by a reference numeral 10 and includes a metallic body or mass 12 that is fixedly attached to a first end 14 of a metal twisted or braided wire or cable 16. The weight of the mass 12 required depends upon the conditions at which it is desired to have the initiator 10 become actuated for firing the projectile, specifically the acceleration and the force of the impact. The mass 12 rests upon a rounded shoulder 18 that is provided at one end of a sleeve 20 which is positioned in a cavity 22 in the projectile body 24. As those skilled in the art will understand, the sleeve 20 may be dispensed with, if desired. In such case, however, greater care is required in forming cavity 22 in order to provide a wall surface with no imperfections of a kind that might impede the movement of mass 12 upon impact of the projectile with a resistant target.

The shoulder 18 in sleeve 20 prevents set back of the body or mass 12 upon forward acceleration of the projectile, the forward direction being indicated by the arrow 26. Arrow 26 is positioned coincident with the central axis, indicated by a dot-and-dash line 28, of the projectile.

The mass 12, shown as a sphere, is normally retained in position against shoulder 18 by a shear-pin 30 which is inserted in one side of projectile body 24 through a hole 32 at one side of cavity 22, through a plurality of holes in alignment therewith comprising holes 34 and 36 in sleeve 20, a hole 38 in mass 12, and a hole 40 in body 24 on the diametrically opposite side of cavity 22.

The metal cable 16 extends through openings 42 and 44 in the sleeve 20 and projectile body 24, respectively, and is turned transversely to the central axis 28 of the projectile over a pulley or roller 46 that is suitably pivoted to the projectile body 24 by means, not shown. From the pulley 46, the cable 16 is passed through an affixed keeper-washer 48 and a shoulder 50 in a metal sleeve 52 into a friction primary mixture 54 contained in the sleeve 52. Closely adjoining the friction primer mixture 54 in sleeve 52 is a pellet 56 of booster primary high explosive which, in turn, closely adjoins the main charge of secondary high explosive 58 of the projectile. Metal sleeve 52 is fixedly attached by means not shown, in order to avoid undue complication of the drawing, to the pyrometer body 24 with the longitudinal axis 60 thereof displaced about 90 degrees from the projectile central axis 28.

Friction primary mixture 54 may be of a type, common to the art, that are used as artillery friction primers, for example, lead styphnate or lead azide. Booster primary explosive 56 may be of a type such as tetryl or PETN which comprise detonating agents for less sensitive high explosives.

Upon firing of the projectile and resulting acceleration on the central axis 28, and in rotation or spin about the central axis 28, the spherical mass 12 is carried forward by the retention shoulder 18 and the cable 16 is checked from radial movement in the friction primary mixture 54 by the keeper-washer 48. The metal sleeve in which the keeper-washer 48 is mounted prevents rotation of the keeper-washer/cable system about the central axis of the projectile/initiator system, thereby minimizing any tension which could be transmitted to the cable 16 upon firing of the projectile and any resulting subsequent motion thereof while in flight.

Figure 2:
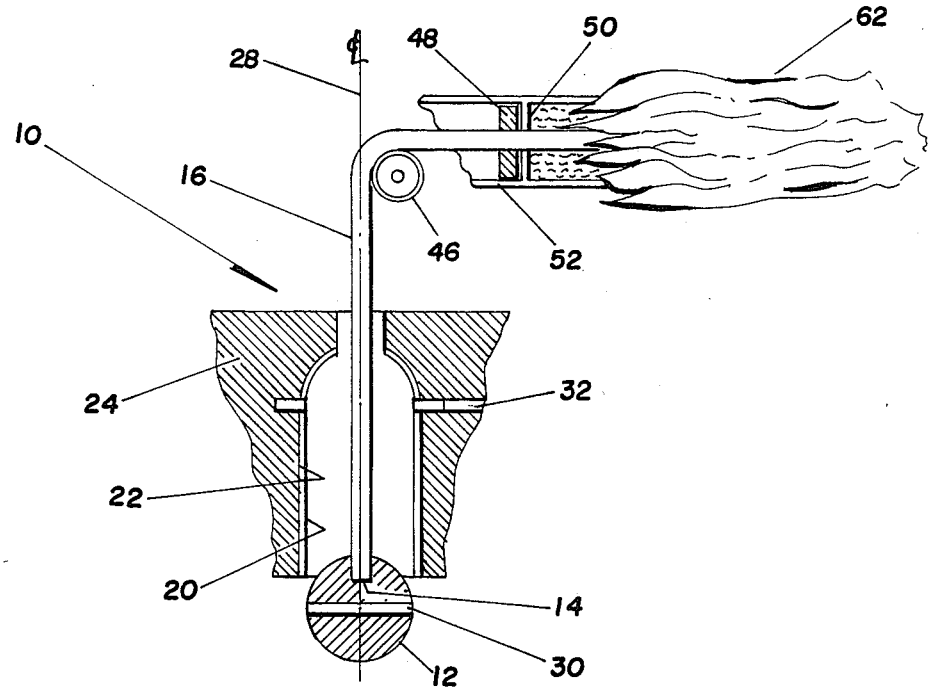
FIG. 2 is a view similar to that of FIG. 1 but illustrates the operation of the initiator in being actuated to cause the projectile to explode upon impact of the projectile with the target or other resistant body.

Upon impact of the projectile with a resistant target medium, the spherical mass 12 is urged voilently in the forward direction to a position as shown in FIG. 2, causing the shear pin 30 to fail whereupon the braided or twisted metal cable 16 is jerked from the friction primer mixture 54 causing the mixture 54 to ignite. If desired, the second end of the cable 16 may be coated with a scratch mix to facilitate ignition of the mixture 54. As known in the art, however, with some mixtures 54 such a scratch mix coating is not required.

Upon ignition of mixture 54, flame spreads to the booster primary high explosive 56 which passes a blast front to the main charge of secondary high explosive 58, thereby setting off the latter as indicated at 62.

It is to be noted that during routine storage, the shear-pin 30 is the only necessary safety device. The shear-pin 30 is not removed before projectile launch.

Thus, in accordance with the invention, there is provided an inertia type friction initiator for rotating projectiles in which no arming before projectile launch is required, and the initiator is self-arming upon projectile impact with a resistant target medium. The initator of the invention is further characterized in that it is resistant to inadvertent arming; the keeper-washer/sleeve system prevents premature actuation by radial acceleration during projectile launch; the keeper-washer system prevents actuation by tangential acceleration during projectile launch; the approximate 90 degree off-central-position of much of the cable friction device minimizes inertia effects of an on-axis projectile launch; and additionally, the shear-pin 30 is selected such that minor on-axis impacts such, for example, as dropping of the projectile that may tend to occur during storage, handling, shipment and loading will not cause initiatior actuation.

What is claimed is:

1. An inertia type friction initiator for a rotating projectile having a central axis comprising, a cable having a first end and a second end, and having a first portion adjacent said first end and a second portion adjacent said second end, a mass means, cavity forming means providing a cylindrical cavity having a narrowed opening at one end, a shoulder around said opening for supporting said mass means in said cavity, and having a longitudinal axis that is in substantial parallel alignment with the central axis of the projectile, a shear pin extending through said mass means and at least a portion of said cylindrical cavity forming means to retain said mass means against said shoulder, sleeve forming means providing a sleeve having a longitudinal axis that is positioned transversely of the longitudinal axis of said cylindrical cavity and is displaced axially of said cavity in a direction opposite the direction of movement of the projectile when launched for flight, said sleeve having a keeper-washer therein, a shoulder against one side of which said keeper-washer is in engagement and on the other side of which there is provided friction initiating means, said keeper-washer and shoulder each having an opening therein, said cable having said first end extending through the narrowed opening in said cavity and fixedly attached to said mass means, said cable for said first portion extending in a direction that is substantially parallel to the central axis of the projectile, said direction being opposite to the direction of movement of the projectile when launched for flight, and said cable having said second end thereof extending through the opening in the keeper-washer and shoulder in said sleeve into physical contact with said friction initiating means, said cable being affixed to said keeper-washer, and means for guiding said second portion of said cable in a direction transversely of the central axis of the projectile.

2. An initiator as specified in claim 1 wherein said means for guiding said second portion of said cable comprises a pulley attached for rotation to the projectile on an axis transverse to the central axis thereof.

3. An initiator as specified in claim 1 wherein said friction initiating means comprises a friction primer mixture with which said second end of said cable is in contact, and additionally, in tandem, a booster primary high explosive and a main charge of secondary high explosive.

4. An initiator as specified in claim 1 whereby said mass means is in the form of a spherical body and said shoulder in said cavity for supporting said mass means is rounded.

5. An initiator as specified in claim 4 wherein said cavity forming means includes a sleeve having a rounded shoulder at one end against which said spherical body is retained by said shear pin.

6. An initiator as specified in claim 1 wherein said means for guiding said second portion of said cable comprises a pulley attached for rotation to the projectile on an axis transverse to the central axis thereof, wherein said mass means is in the form of a spherical body and said shoulder in said cavity for supporting said mass means is rounded, and wherein said friction initiating means comprises a friction primer mixture with which said second end of said cable is in contact.

* * * * *